4/9/85 OR 4,509,365

United States Patent [19]

Eineichner et al.

[11] Patent Number: 4,509,365

[45] Date of Patent: Apr. 9, 1985

[54] METHOD AND APPARATUS FOR WEIGHING A SUCKER-ROD PUMPED WELL

[75] Inventors: Donald E. Eineichner, San Jose; Rangasami S. Chandra, Walnut Creek; James M. Tucci, Campbell, all of Calif.

[73] Assignee: FMC Corporation, Chicago, Ill.

[21] Appl. No.: 535,490

[22] Filed: Sep. 26, 1983

[51] Int. Cl.[3] ..... E21B 47/00

[52] U.S. Cl. ..... 73/151; 73/168

[58] Field of Search ..... 73/151, 168; 417/63; 364/422

[56] References Cited

U.S. PATENT DOCUMENTS 3,457,781 7/1969 Elliott ..... 73/151

3,824,851 7/1974 Hagar et al. ..... 73/151

*Primary Examiner*—Jerry W. Myracle

*Attorney, Agent, or Firm*—Lloyd B. Guernsey; H. M. Stanley; R. B. Megley

[57] ABSTRACT

Method and apparatus for checking a sucker-rod pumped well for defects by weighing the well. A load cell connected between the sucker-rod and a power unit develops a signal representative of the load on the sucker-rod. The sucker-rod load is checked with the rod and an associated downhole pump plunger in a stationary position. The load readings are corrected for load cell drift by a computer, and a corrected load value displayed on a digital display unit. The load readings are updated periodically and any changes in load reading can be used to determine the presence of a defect and to ascertain the type of defect in the pumping apparatus.

17 Claims, 14 Drawing Figures

FIG_1
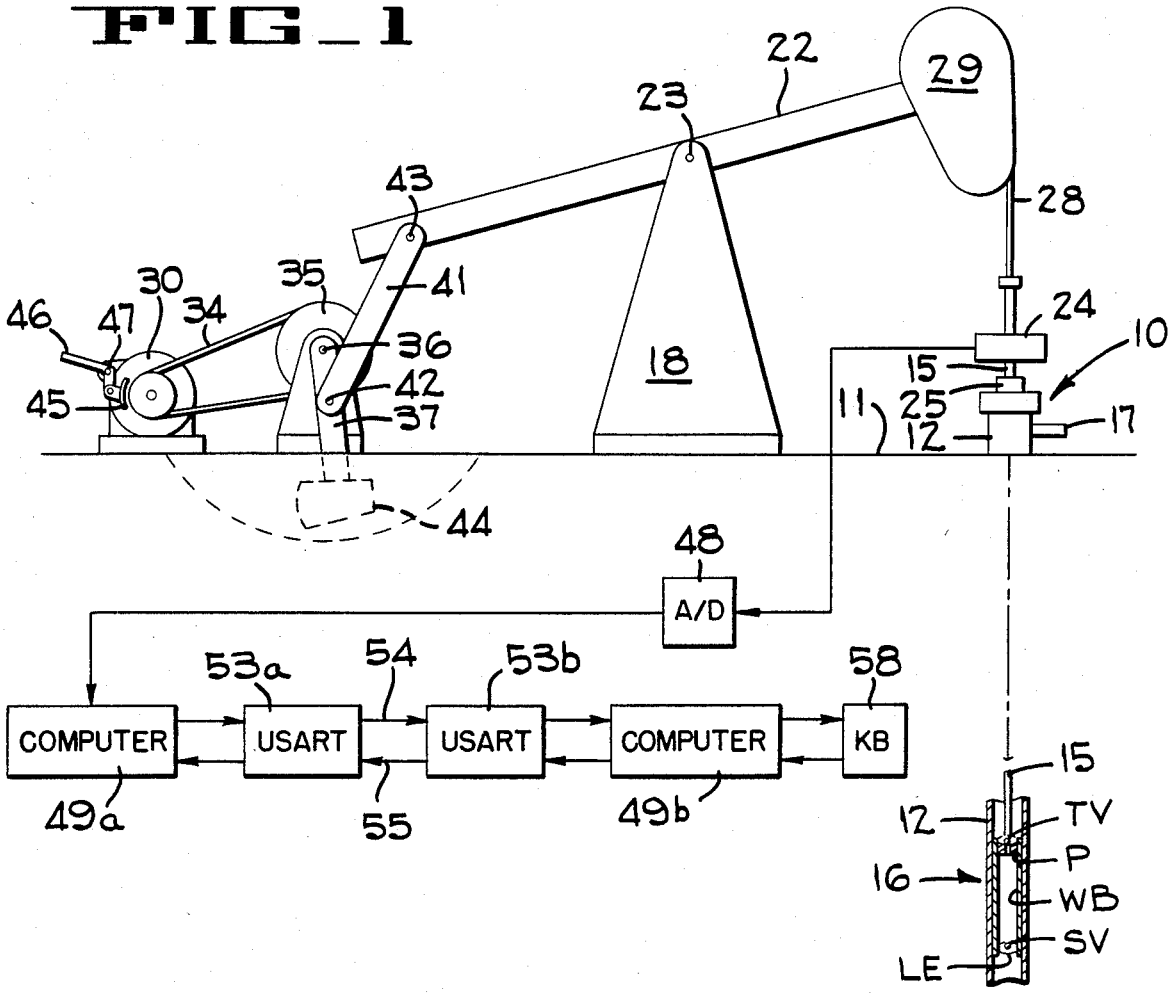
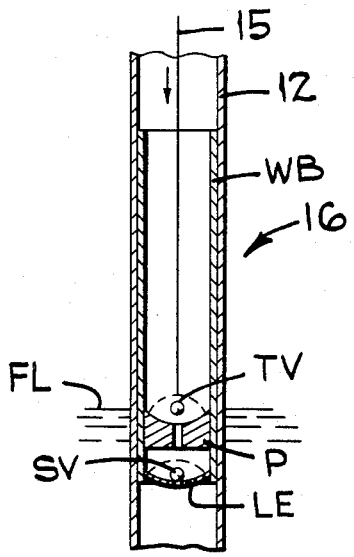
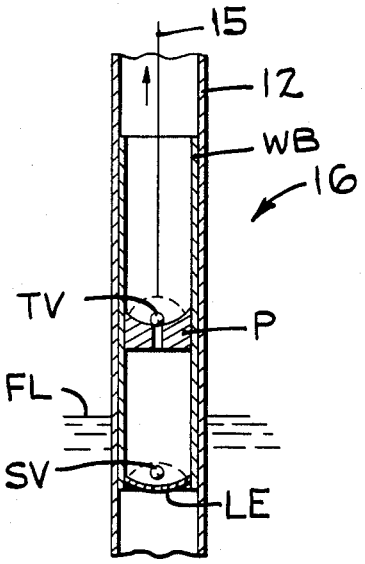
FIG_2A FIG_2B

| | STATE 1 | STATE 2 | STATE 3 |
|---|---|---|---|
| MESSAGE 1 | PROCESS A | PROCESS D | PROCESS G |
| MESSAGE 2 | PROCESS B | PROCESS E | PROCESS H |
| MESSAGE 3 | PROCESS C | PROCESS F | PROCESS I |

STATE MACHINE SYMBOLOGY

CONTROLLER MESSAGE SWITCHED OPERATING SYSTEM

PLOTTER MESSAGE SWITCHED OPERATING SYSTEM

FIG_8
STATE MACHINE SCHEDULER
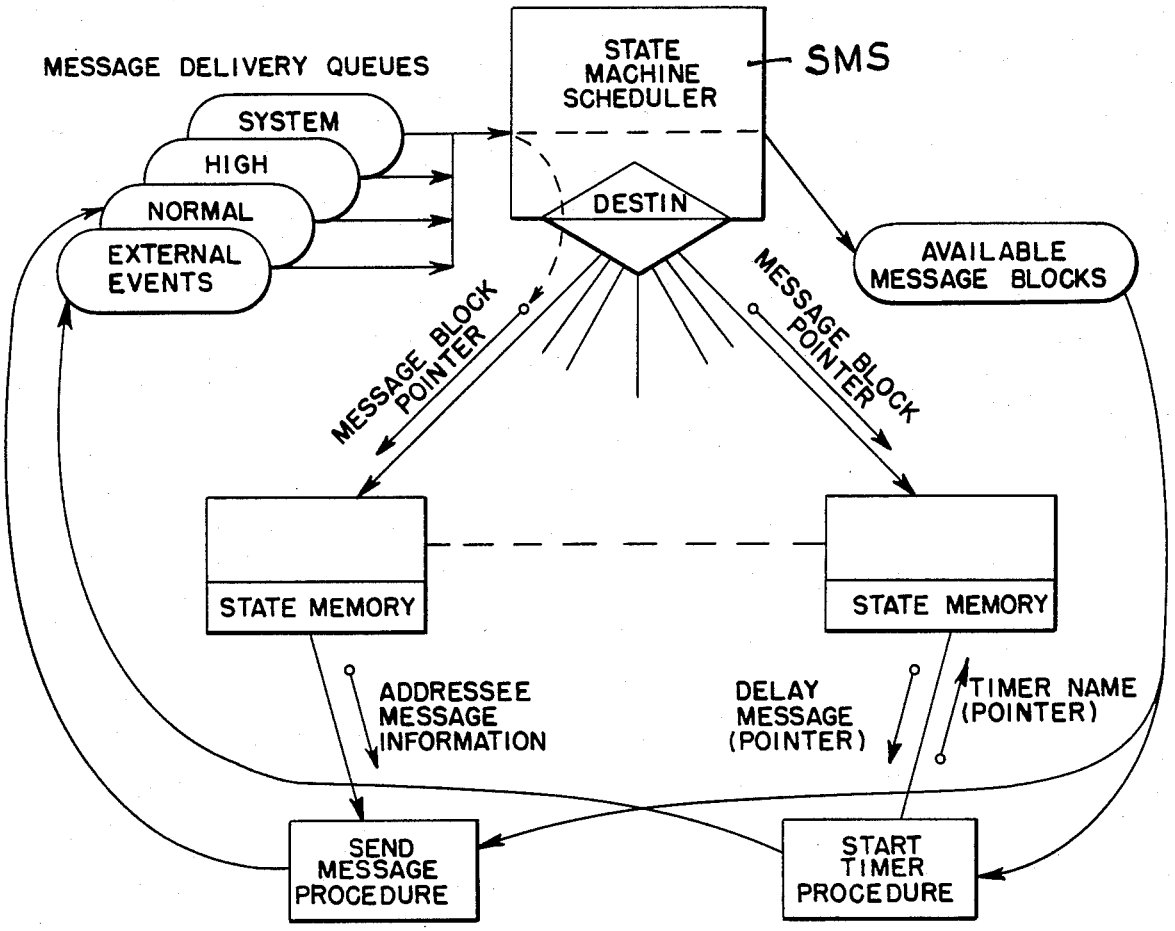
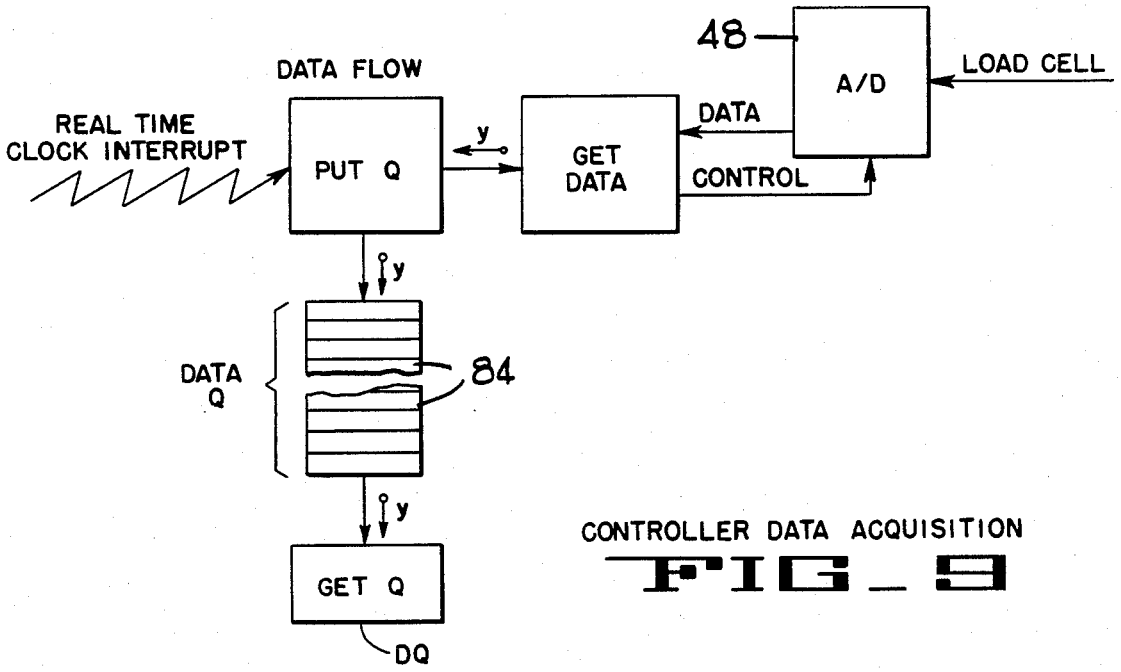
CONTROLLER DATA ACQUISITION
FIG_9

MESSAGE FLOW DIAGRAM

STATE DIAGRAM WEIGH HANDLER

STATE DIAGRAM HALT MANAGER

METHOD AND APPARATUS FOR WEIGHING A SUCKER-ROD PUMPED WELL

BACKGROUND OF THE INVENTION

The present invention relates to methods and apparatus for weighing a sucker-rod pumped well, and more particularly, to methods and apparatus for checking various portions of the apparatus by weighing the well.

Sucker-rod type pumping units are widely used in the petroleum industry in order to recover fluid from wells extending into subterranean formations. Such units include a sucker-rod string which extends into the well and means at the surface for an up and down movement of the rod string in order to operate a downhole pump. Typical of such units are the so-called "beam-type" pumping units having the sucker-rod string suspended at the surface of the well from a structure consisting of a Samson post and a walking beam pivotally mounted on the Samson post. The upper end portion of the sucker-rod string normally is connected at one end of the walking beam and the other end of the walking beam is connected to a prime mover such as a motor through a suitable crank and pitman connection. In this arrangement the walking beam and the sucker-rod string are driven in a reciprocal mode by the prime mover.

The lower end of the sucker-rod string is connected to a plunger which is moved up and down inside a working barrel of the downhole pump to lift fluid from the pump to the earth's surface. The pump includes a traveling valve mounted on a plunger with the traveling valve designed to lift off a valve seat when the plunger is moving downward through liquid inside the barrel and the traveling valve is closed to lift the fluid as the plunger moves upward inside the barrel. A standing valve at the lower end of the working barrel opens to admit fluid into the barrel as the plunger moves upward, and the standing valve closes to retain fluid in the barrel as the plunger moves downward in the barrel. A length of tubing extending from the pump barrel to the earth's surface carries fluid upward from the pump to a flow line at the surface.

If the tubing should leak or if the traveling valve or the standing valve should malfunction the fluid flow to the surface will be reduced or stopped and damage to other portions of the equipment could result.

SUMMARY OF THE INVENTION

The present invention provides new and improved methods and apparatus for detecting malfunctions in a well pumping unit having a sucker-rod string and a power unit to reciprocate the rod string to produce fluid from a well. A load cell is connected between the sucker-rod string and the power unit to develop a signal representative of the load on the rod string. Malfunctions in the pumping equipment are detected by "weighing the well" and noting any variations in the weight of the well. In order to insure accuracy in the weighing of the well the load cell is checked by clamping the upper end of the rod string so the weight of the rod string is removed from the load cell, then noting the load cell reading and using this reading as the zero offset error of the load cell. A compensated zero or zero offset value can be stored in a computing means to compensate for load cell drift and this offset value can be subtracted from any future load cell readings.

A traveling valve and a plunger in the downhole pump are checked on the upstroke of the plunger by braking the plunger and rod string to a gradual stop near the end of the upstroke and checking the load on the load cell. If the traveling valve or the plunger should leak, the load will transfer from the traveling valve to a standing valve in the downhole pump and the load on the load cell will rapidly decrease. If there are no leaks in the traveling valve or at the plunger the load remains fairly constant on the load cell during a test period.

The standing valve and a working barrel of the downhole pump are checked on the downstroke by braking the plunger and rod string to a stop near the end of the downstroke and checking the load on the load cell. If the standing valve leaks the traveling valve will close and the load will transfer back to the plunger and to the load cell.

A computer can be used to store the zero offset error of the load cell and to periodically subtract the offset error value from a load cell value to obtain and display a corrected value of load on the rod string. The corrected load reading can be presented to a digital display unit to facilitate reading load values.

BRIEF DESCRIPTION OF THE DRAWINGS

FIG. 1 is a diagrammatic illustration of a well equipped with a sucker-rod type pumping unit and illustrating a basic downhole pump.

FIGS. 2A and 2B are enlarged cross sections of the downhole pump showing operation of the pump.

FIG. 8 illustrates a software state machine scheduler of the present invention.

FIG. 9 illustrates the flow of data through the operating system of the present invention.

DESCRIPTION OF THE PREFERRED EMBODIMENT

Figure 3A:
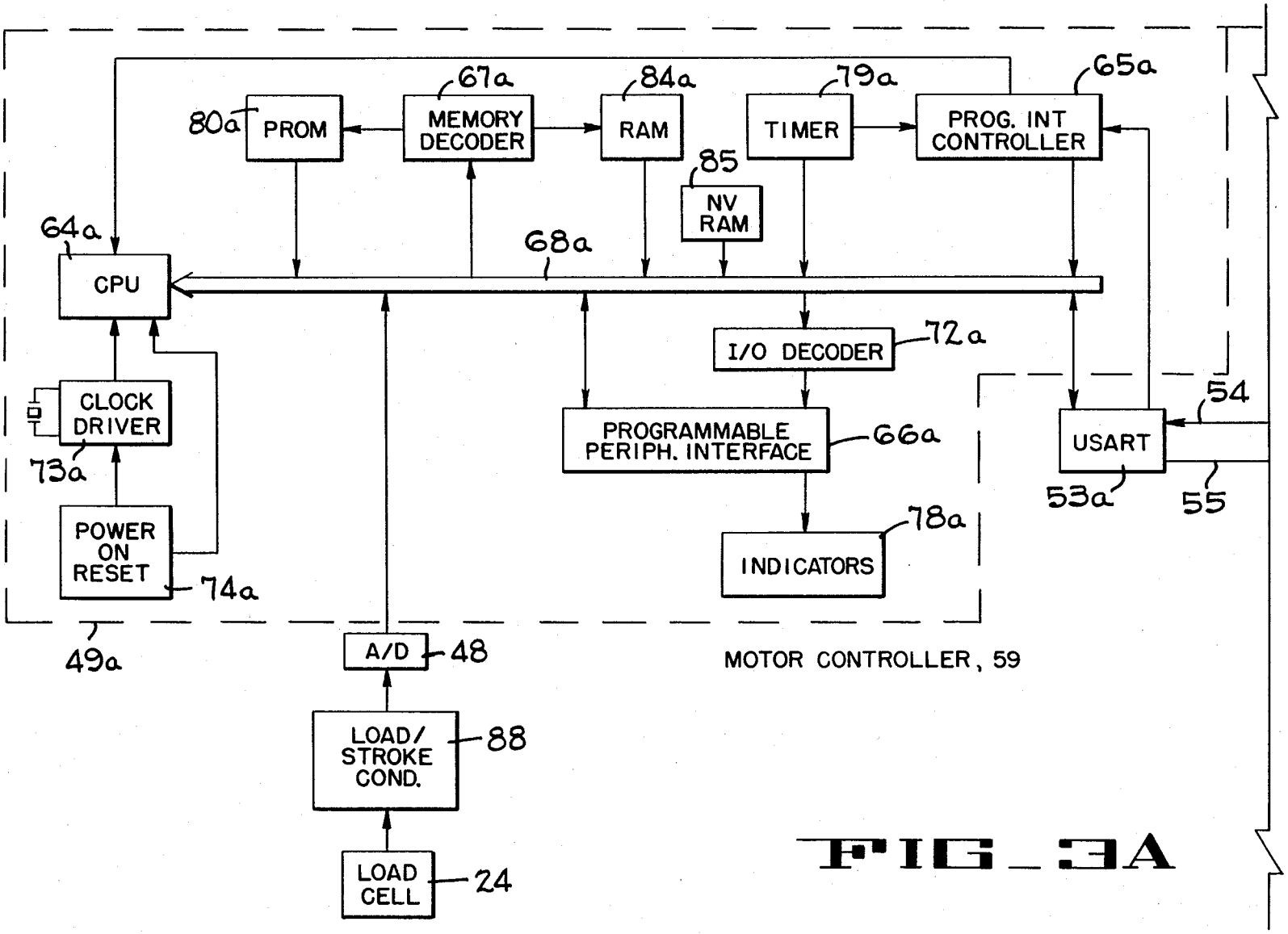
FIGS. 3A, 3B comprise computer circuitry which can be used in the apparatus of FIG. 1.

Referring to FIGS. 1–2B, there is illustrated a wellhead 10 of a well which extends from the earth's surface 11 into a subsurface well producing formation having a fluid level FL (FIGS. 2A, 2B). The wellhead comprises the upper portions of a casing string 12 with a sucker-rod string 15 extending downward to a downhole pump 16 which moves liquid to the surface where it passes into a flow line 17. The sucker-rod string 15 is suspended in the well from a support unit consisting of a support post 18 and a walking beam 22 which is pivotally mounted on the support post by a pin connection 23. A load cell 24 is connected between the upper end of the sucker-rod string 15 and the lower end of a cable section 28. The cable section 28 is connected to the walking beam 22 by means of a horsehead 29. A clamp 25 atop the casing string 12 is used to support the weight of the rod string 15 and liquid inside the casing string while the load cell calibration is checked for a zero load reading.

The walking beam 22 is reciprocated by a prime mover such as an electric motor 30. The prime mover drives the walking beam through a drive system which includes a drive belt 34, crank 35, crank shaft 36, crank arm 37, and a pitman 41 which is pivotally connected between the crank arm and the walking beam by means of pin connections 42, 43. The outer end of the crank arm 37 is provided with a counterweight 44 which balances a portion of the load on the sucker-rod string in order to provide a more constant load on the prime mover.

The lower end of the sucker-rod string 15 is connected to a plunger P which is movable inside a working barrel WB of the pump 16. The plunger P includes a traveling valve TV (FIGS. 1, 2A, 2B) which closes on an upstroke of the plunger P to lift fluid toward the earth's surface 11, and the traveling valve TV opens when the plunger moves downward through fluid inside the working barrel WB. A standing valve SV (FIGS. 1, 2A, 2B) at the lower end of the working barrel WB opens to allow fluid to flow into the working barrel as the plunger P moves upward, and the standing valve closes to retain fluid in the working barrel as the plunger P moves downward in the working barrel. Thus, a column of fluid inside the casing string 12 is supported by the plunger P during the time the traveling valve is closed and the plunger is on the upstroke, and the column of fluid is supported by the standing valve SV and by a lower end LE of the pump when the plunger P is moving downward through fluid in the working barrel WB of the pump. This normal change of load can be used to test the condition of the traveling valve and the standing valve by using the load cell 24 (FIG. 1) to check the value of the load on the rod string when the plunger is on the upstroke and again when the plunger is on the downstroke.

When the plunger P is stopped near the upper end of the upstroke the weight of the column of fluid continues to be supported by the rod string unless the traveling valve TV or the plunger P should leak. If the traveling valve leaks the fluid flows down so the working barrel WB below the plunger fills with fluid and the standing valve SV supports the weight of the column of fluid so the weight on the rod string decreases and the reading of the load cell 24 (FIG. 1) decreases. Thus, the condition of the traveling valve can be ascertained by observing the weight reading on the load cell with the plunger stopped near the top of the upstroke. The plunger can be brought to a stop at a desired location by actuating a brake 45 (FIG. 1) to bring the motor 30 to a stop. The brake 45 is connected to a brake handle 46 which is pivotally connected to the frame of the motor 30 by a pin 47. A moderate downward pressure on the handle 46 by a human operator, with the motor power switched off, brings the plunger P to a gradual stop with a minimum of vibration in the system.

When the plunger P is stopped near the end of the downstroke the weight of the column of fluid should be supported by the standing valve SV and by the lower end LE of the pump. If the standing valve should leak the weight of the column of fluid will be transferred to the plunger and to the rod string and the reading of the load cell 24 (FIG. 1) will increase. This increase in the reading of the load cell indicates that the standing valve is defective or that the working barrel WB of the pump is leaking.

The load cell 24 (FIGS. 1, 3A) provides a DC output signal which is proportional to the load on the sucker-rod string 15, and an analog-to-digital converter 48 provides a corresponding digital signal to a computer **49*a* which cooperates with another computer 49*b* to weigh the well and check for faults in the pumping system. Signals are transferred between the computers 49*a*, 49*b* by a pair of universal synchronous asynchronous receiver transmitters (USARTs) 53*a*, 53*b* over a plurality of wires 54, 55. Instructions from a keyboard and display unit 58 (FIG. 3B) are used to zero offset the load cell 24 and to perform checks on the standing valve SV and on the traveling valve TV (FIGS. 2A, 2B**).

Figure 3B:
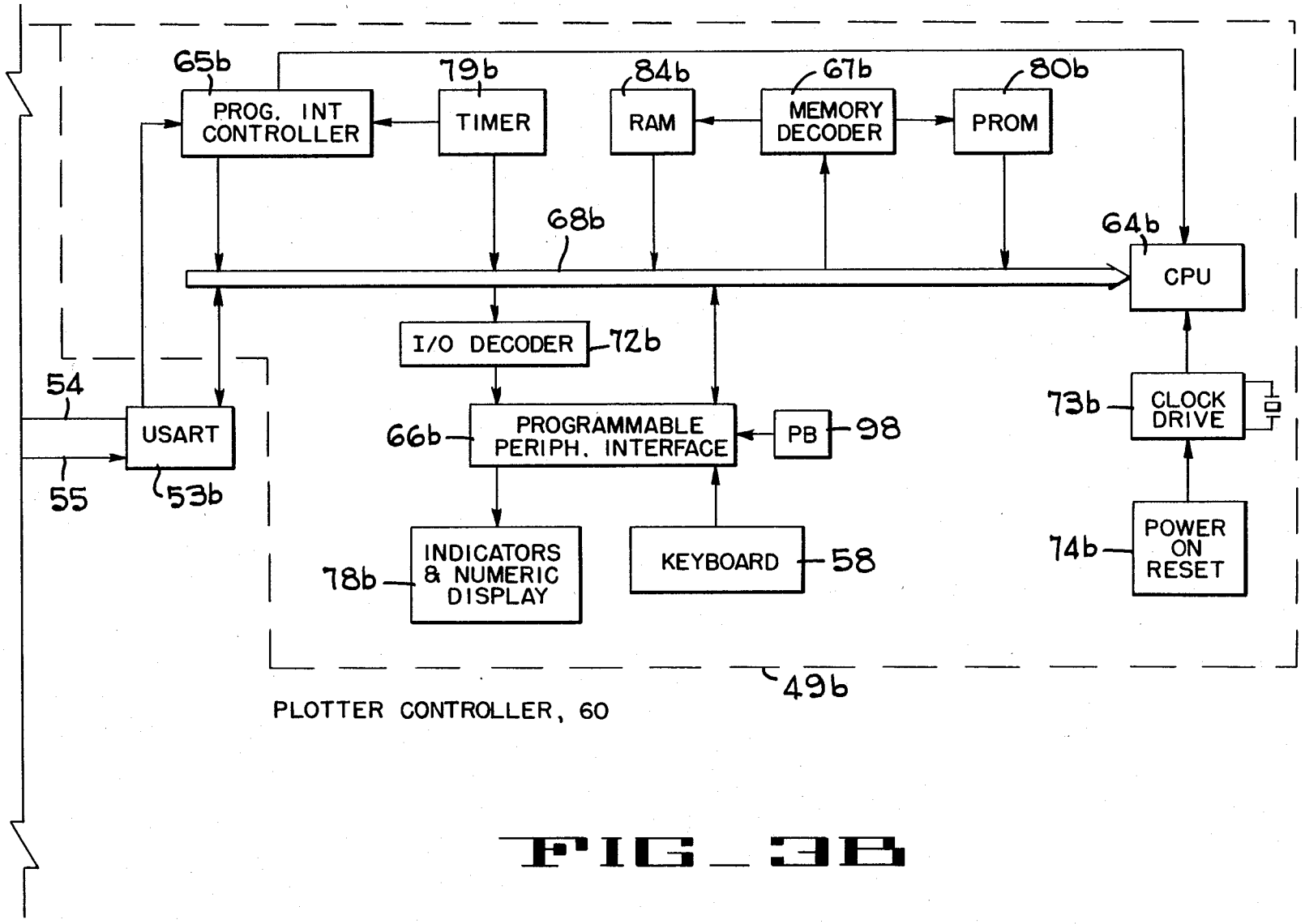

A human operator uses the keyboard to request a display of the reading of the load cell 24 (FIGS. 1, 3A) on a digital display portion of the keyboard and the display unit 58 (FIG. 3B). A reading of the load cell with the weight of the rod string supported by the clamp 25 (FIG. 1) is entered into the computers **49*a*, 49*b* as a zero value which is subtracted from the future readings to obtain a true value when the rod string is supported by the load cell. The apparatus of FIGS. 1, 3A, 3B is used to check the condition of the traveling valve TV (FIGS. 2A, 2B**), the standing valve SV and other portions of the pumping system.

Details of a method and apparatus for checking the condition of the traveling valve and the standing valve, and for zero adjustment of the load cell used to make these checks are disclosed in FIGS. 3A, 3B and 10–12. When FIGS. 3A, 3B are placed side-by-side with leads from the right side of sheet 3A extending to corresponding leads from the left side of sheet 3B, the two sheets comprise a block diagram of an embodiment of the computers **49*a*, 49*b* (FIG. 1**).

The portion of the computer system disclosed in FIG. 3A comprises a motor controller 59 for receiving signals from the load cell 24 and for using the signals to transmit load values on request to computer **49*b*. The computer 49*b* disclosed in FIG. 3B comprises a plotter controller 60 for using the load cell signals transmitted from computer 49 to operate the display unit 58. Signals are interchanged between the motor controller 59 and the plotter controller 60 over the pair of interconnecting wires 54, 55**.

Each of the controllers 59, 60 includes a central processor **64*a*, 64*b*, a programmable interrupt controller 65*a*, 65*b*,3a programmable peripheral interface 66*a*, 66*b* and a memory decoder 67*a*, 67*b* connected for the interchange of information and instruction over a bus system 68*a*, 68*b*. A central processor 64*a*, 64*b* which can be used in the present invention is the model 8088 manufactured by Intel Corporation, Santa Clara, Calif. A programmable peripheral interface 66*a*, 66*b* which can be used is the model 8255A and a programmable interrupt controller 65*a*, 65*b* which can be used is the model 8259A, both manufactured by Intel Corporation. An input/output decoder 72*a*, 72*b* decodes address signals for selectively enabling the peripheral interfaces 66*a*, 66*b* to send and receive information from the bus system 68*a*, 68*b***.

Clock pulses for driving the central processor **64*a*, 64*b* are provided by a pair of clock drivers 73*a*, 73*b* which are initialized by a pair of "power on reset" generators 74*a*, 74*b*. The generator 74*a* also includes a power fail circuit to warn that power to the controller is failing. A clock driver 73*a*, 73*b*** which can be used in the present invention is the model 8284A manufactured by the Intel Corporation. A pair of indicating devices 78*a*, 78*b* provide visual display of information from the peripheral interfaces 66*a*, 66*b*. The indicating device 78*a* also includes a plurality of switches for entering information into the motor controller. A pair of timers 79*a*, 79*b* provide timing signals to operate the controllers 65*a*, 65*b* and information is transferred between the motor controller 59 and the plotter controller 60 by the pair of universal synchronous asynchronous receiver transmitters (USARTs) 53*a*, 53*b*. One such USART which can be used in the present invention is the model 8251A manufactured by Intel Corporation. Programs for operating the motor controller 59 and the plotter controller 60 are stored in a PROM 80*a*, 80*b*, and data for use in the system is stored in a RAM 84*a*, 84*b*. Data to be retained during a power failure can be stored in a nonvolatile RAM 85. A load/stroke conditioner 88 (FIG. 3A) amplifies and filters signals transmitted from the load cell 24 and sends the smoothed signal to the bus 68*a* through the analog-to-digital converter 48. An analog-to-digital converter which can be used is the model AD574A manufactured by Analog Devices.

The general operation of a method for weighing a well using apparatus of the present invention has been described in connection with FIGS. 1–3B. A detailed description of the method of using the motor controller 59 and the plotter controller to weigh the well will be described in connection with FIGS. 4–9 which provide background for the use of software state machines and of their use in operating the apparatus of FIGS. 1, 3A and 3B and provide details of the operation of a computer program used in carrying out various operations performed by the computer of FIGS. 3A, 3B.

The program of the present computer is supported by a real time operating system having various routines that are not applications oriented and that are designed specifically to support programs designed with the state machine concept, that is, a state, input driven program. Some of the routines are sub-routines while others form a module that creates a simple real-time environment under which software state machines can operate. The operating system provides equipment in which a collection of software state machines can operate.

Figures 4, 5:
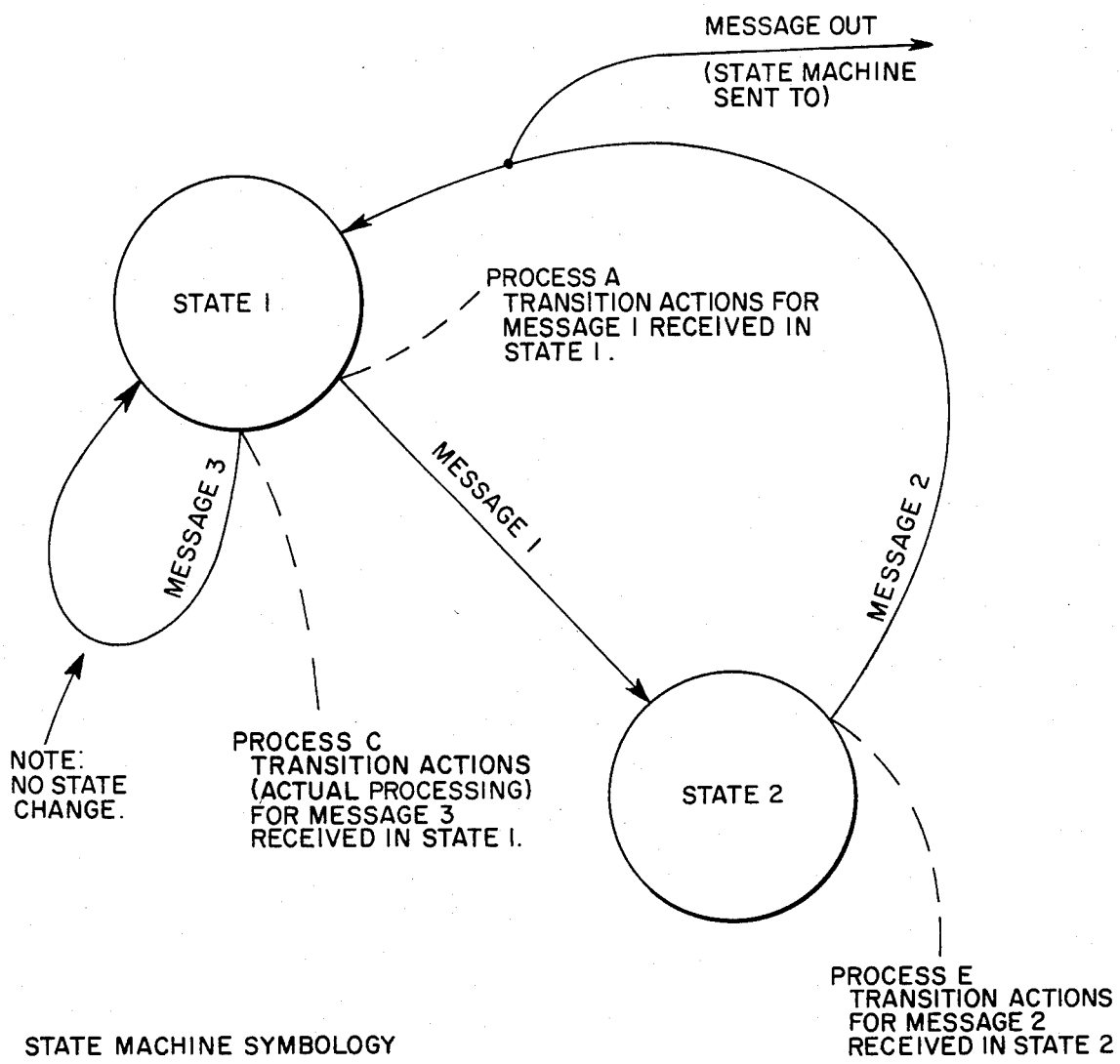
FIG. 4 is a matrix diagram illustrating the operation of software state machines used in the present invention.
FIG. 5 is a diagram illustrating symbology of a typical software state machine used in the present invention.

A software state machine is a process that is executed on the digital computer each time that a message is sent to the state machine. The process does not execute in exactly the same way each time that a like message is sent to it because the processing to be done for any message depends on the machine's "state", i.e., its memory of all prior processing that it has done in response to the previous messages. The state can be any length, from eight binary digits to several thousand binary digits depending upon the complexity of a given machine. Given the state of the machine and the current message, the machine will do a given set of processing which is totally predictable. A machine can be represented as a matrix of processes, indexed by a state and a message as shown in FIG. 4. For example, if the state machine of FIG. 4 receives message number one in state one, then process A will be done. If process A were to cause the state to be changed to state 2 then a second message number one, coming right after the first message would cause process D to occur which could cause the machine to change to state 3. It is not necessary that a process cause the state to change, although it may do so in many cases.

A software state machine, upon completing its process defined by the state and by the message returns control to the program that called it, the state machine scheduler which will be described below. During the given process, the machine is not interrupted in order to give processing time to another machine of the same system. Thus, processing time appointment between a given machine and any of its contemporaries in the system is on a message-by-message basis, and such an environment is called a message switched operating system (MSOS). None of the machine's processes are ever suspended for the processes of another machine. For example, if message three comes in state one, process C will begin and end before another state machine can have the central processing unit (CPU) 64*a* (FIG. 3A) to respond to its next message in its given state.

Certain things can cause a state machine process to "suspend". For example, an asynchronous interrupt can be registered and processed. A requirement of the operating environment is that such hardware events are turned into software messages to be processed in order by the responsible state machine. Only that processing that must be done at the exact instant of the interrupt is done and then the interrupt service process will cause a software flag to be raised, ending the interrupt process. When the operating system notes an asychronous flag (semaphore), it generates the needed software message to be sent to the state machine that will carry out the non-time-critical segment of the interrupt processing. An example of such a process is data collection at precisely timed intervals. When the timer interrupt signals that data must be collected, it is read in the required manner dependent on the type of the data, queued in a storage area for processing at a later time, and a flag is raised. When this raised flag is noted by the operating system, a software message is generated, the data is stored and the state machine that is responsible for the processing of this data receives the message at a later time.

A state machine is not given access to the processor by the operating system on a regularly timed basis but is connected to the processor only in order for it to process a message. Whenever the processing of a message is completed the state machine must insure that it will get another message at some point in the future. This is done in the following ways:

(1) Another machine sends a message for synchronizing purposes.
(2) A time period elapses signaled by a timer message.
(3) Real-time data becomes available from some queue.
(4) An input which is being polled, achieves the desired state, and initiates the software message.
(5) An interrupt is sensed and a software message is sent to inform the state machine about this event.

The only time that a machine cannot take care of itself is prior to receiving its first message, so the operating system takes the responsibility of initiating the system by sending to all of the software state machines, functioning therein, an initializing message referred to herein as a "power on" message. No matter what the state of the machine it will respond with a predetermined given process when this message is received independent of the state of the machine.

A convenient means of illustrating the operation of a software state machine is shown in the state machine symbology of FIG. 5 using the messages of FIG. 4 to do some of the processes and to move into some of the states shown in FIG. 4. If we assume the machine (FIG. 5) to be initially in state one, the receipt of message one causes process A to be performed as the transition action for message one received in state one and also causes the machine to move into state two. In state two the receipt of message two causes process E, causes a message to be sent out to another state machine and moves this state machine back into state one. In state one the receipt of message three causes process C as the transition action for receiving message three in state one but does not cause any change in the state of the machine. Some of the other states and processes shown in FIG. 4 are not repeated in FIG. 5 in order to simplify the drawing.

Figure 6:
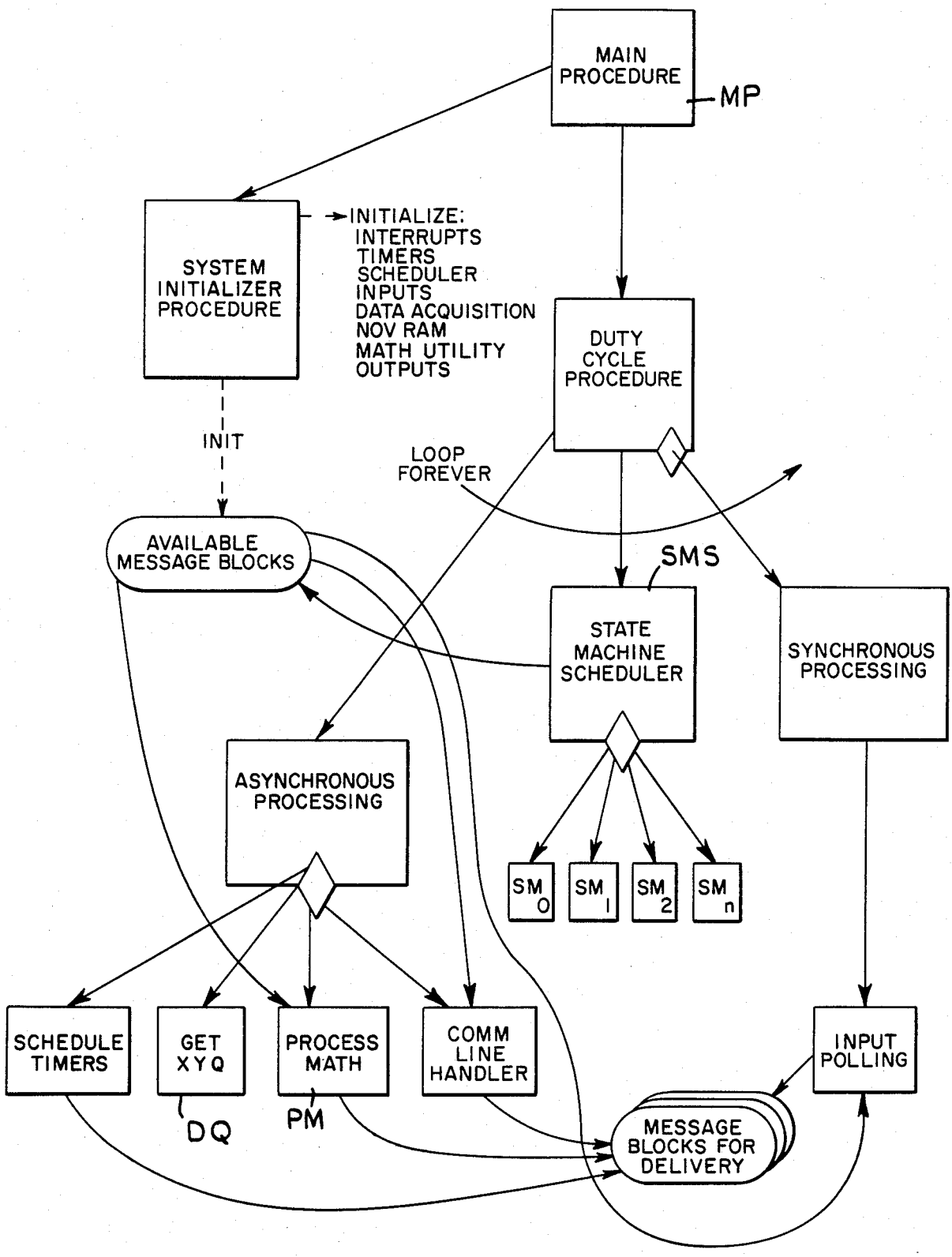
FIGS. 6 and 7 illustrate a message switched software operating system of the present invention.
Figure 7:
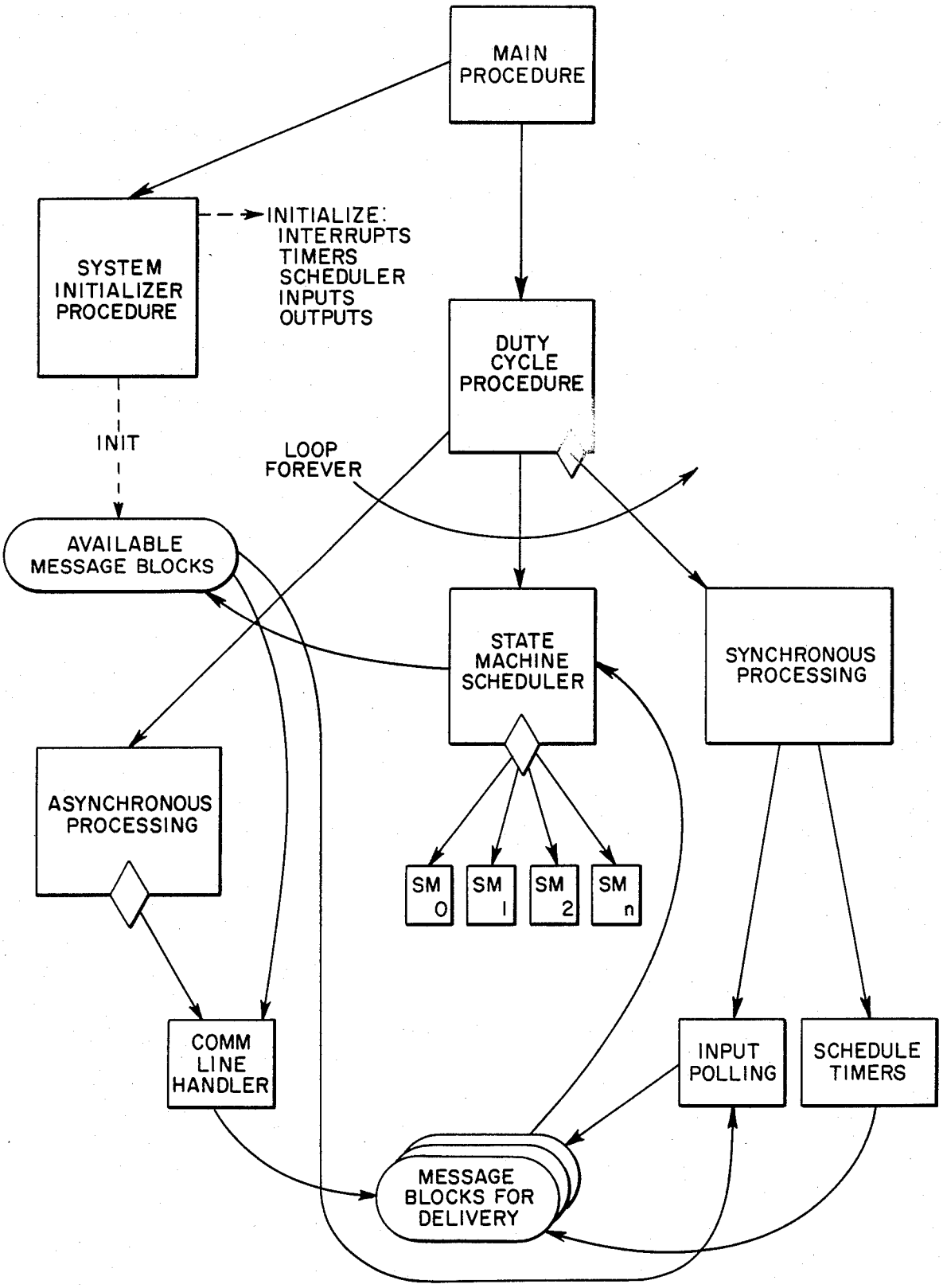

A message switched operating system of the type shown in FIGS. 6 and 7 includes a main procedure which provides signals to initialize the system through a system initializing procedure and includes the initialization of various interrupts, timers, the scheduler, inputs, data acquisition, the nonvolatile RAMs, the math utility and outputs as well as initializing the available message blocks so that all dynamic memory is put into an available space queue for storing data. The procedure then calls the duty cycle procedure which sequentially calls the asynchronous processing, state machine scheduler and synchronous processing over and over again. All interrupt programs communicate with the duty cycle program by way of semaphores. The duty cycle program runs indefinitely with a state machine message delivery, an asychronous operation and all synchronous operations timed by the real-time clock for each cycle of the loop. Asychronous operations that can occur are: data input from a real-time data acquisition queue and communication line interrupts to move characters in and out of the system. In the asychronous operation significant events occuring cause an available message block to be secured and turned into a message to be delivered to whatever state machine is charged with processing the particular interrupt. Since the controller data is queued at the time of acquisition, the transfer operation is asynchronous. If the data processing falls behind the data input, the system can use the time between synchronous clock ticks to catch up on the required operation. Details of the data flow in the asynchronous processing of the DQ block of FIG. 6 are shown in FIG. 9. Signals from the load cell 24 (FIG. 9) are acquired by the GET data procedure and are transferred into the data Q in RAM 84*a* (FIG. 3A) by the PUT Q procedure in response to a real-time clock interrupt and are removed by the GET XY Q procedure.

Once data has been acquired it is sent to all state machines that have signed up for these values using the "send message" procedure (FIG. 8) to place the messages on the queue of messages to be delivered. The synchronous processing performs hardware input polling, timer aging and signal delivery. When an input, requested for polling by any state machine, gets to the desired state such as an off condition, an on condition, above a level or below a level, etc. an available message block is sent as a message to the requesting machine indicating that a given input is in the desired state. The input will no longer be polled until another request is made.

The timer process is slightly different in that the timer queue is made up of message blocks serving as receptacles for the machine requesting the marking of the passage of time and the time of day when the time will be completed. When the time is completed the block is removed from the timer queue and placed on the message delivery queue as a message. Thus, all responsibilities placed on the state machine are accomplished in the operating system by transferring software messages and by the use of real-time flags and queues (semaphores).

The first component of the operating system (FIGS. 6, 7) is a program to deliver a message to a state machine. A message is a small block of dynamic memory that is queued for delivery to a designated state machine. This program is called a state machine scheduler and shown in detail in FIG. 8 selects the next highest priority message from the queues of messages ready for delivery. The machine looks up the designation state machine code stored in the message and uses that code to select the proper state machine program to be called with a pointer to the message block as an input. Contained in the program is a state memory. With the memory and the state the proper process can be delivered and executed, and the memory block transferred from the delivery queue to the available space queue for subsequent reuse. Two examples of data that is reused are instructions for sending the messages or setting timers. These processes take available blocks and turn them into messages that will be on the message delivery queue at some later time. Programs such as the message sender and the timer starter are service utilities called by the state machine in order to fulfill the responsibilities alluded to earlier. The state machine scheduler program is the lowest form of the hierarchy which forms the main duty cycle of the operating system. In the diagram of FIGS. 6, 7 the relationship of the scheduler to the rest of the operating system is shown.

Figure 10:
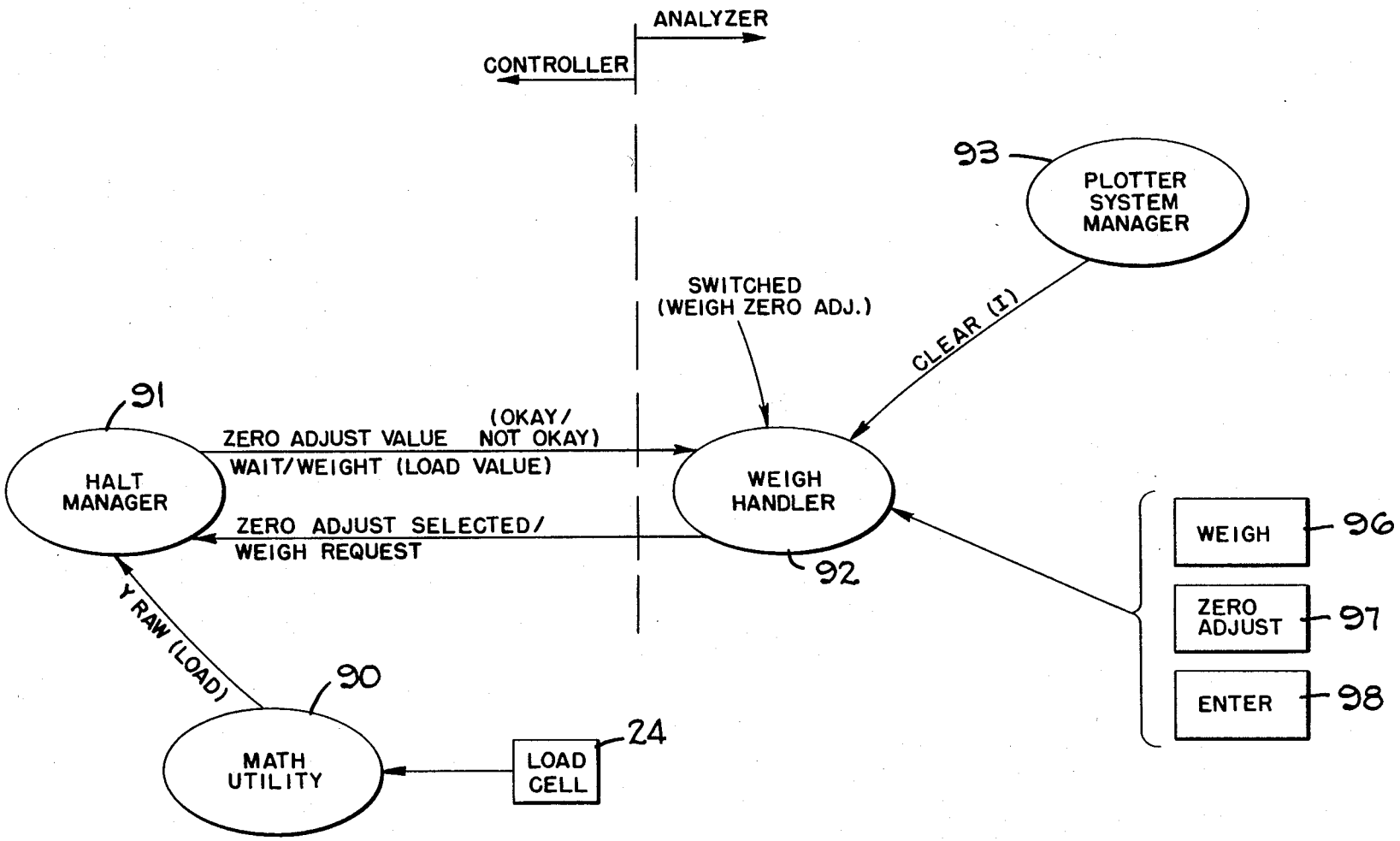
FIG. 10 is a message flow diagram showing the mode of operation of the apparatus of FIGS. 1 and 3A, 3B.
Figure 11:
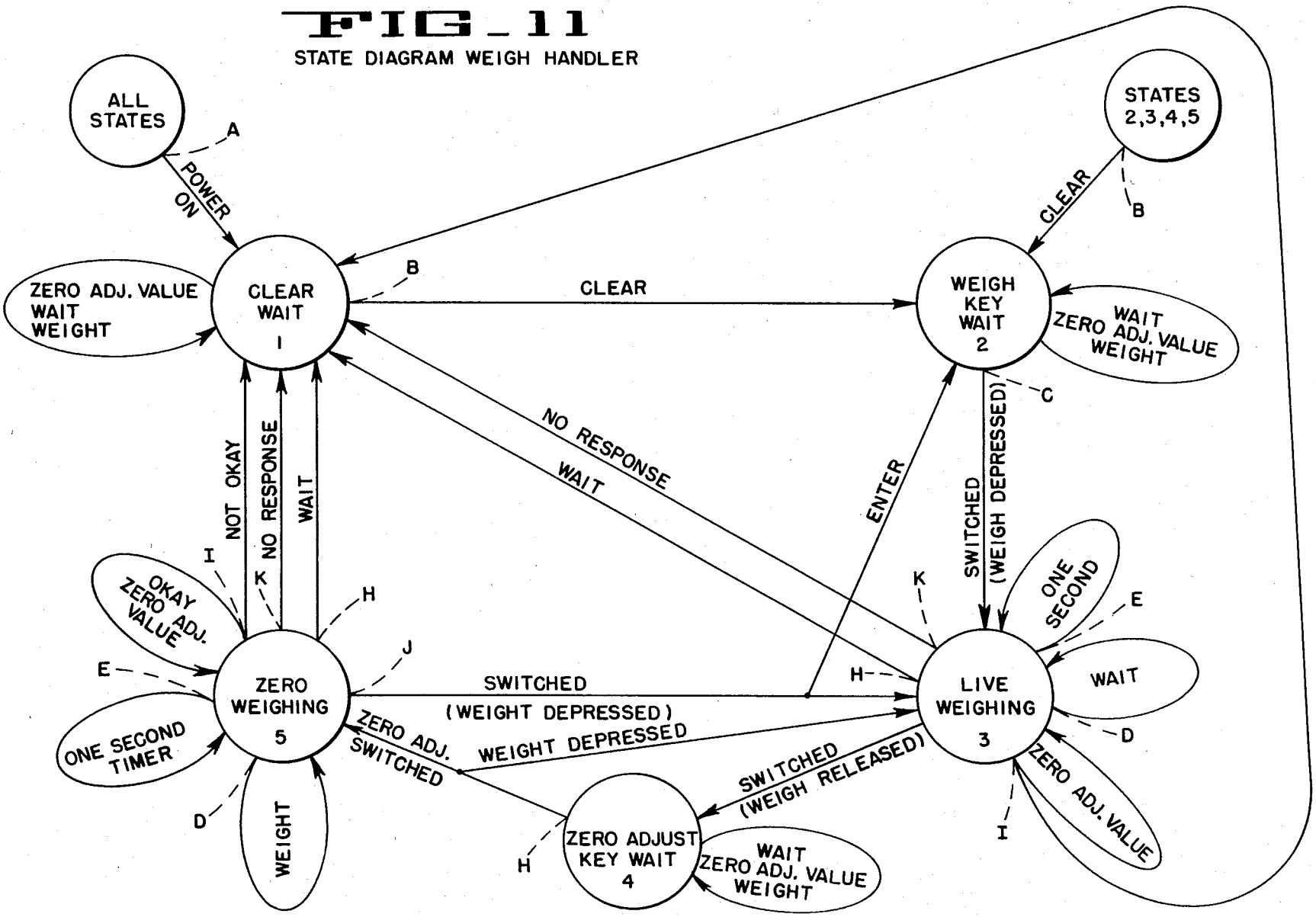
FIG. 11 is a state diagram of a weight handler used to weigh the well shown in FIG. 1.
Figure 12:
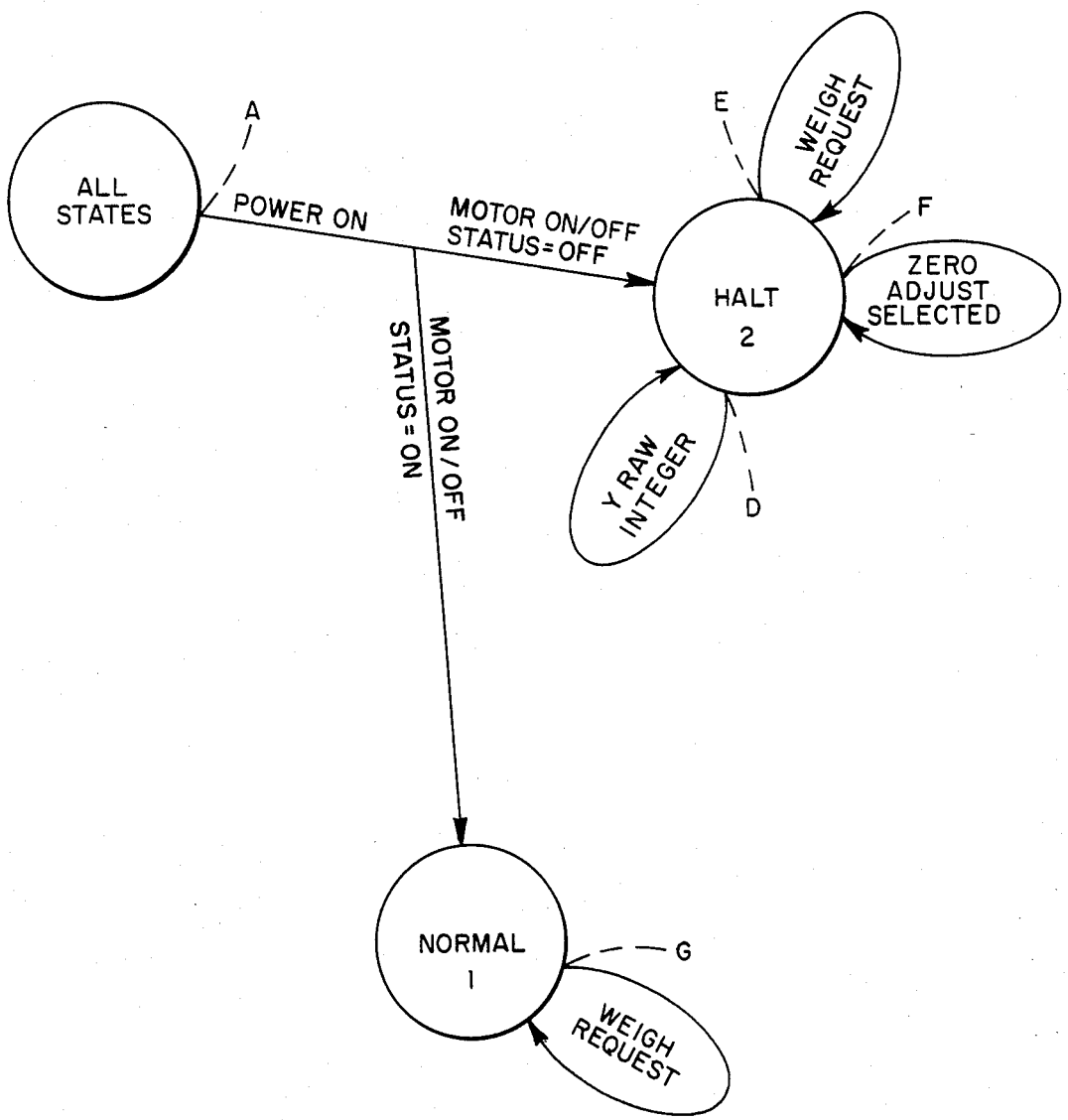
FIG. 12 is a state diagram of the halt manager shown in FIG. 10.

When power is turned on in the computer of FIGS. 3A, 3B, the power on reset generators 74*a*, 74*b* provide signals which reset various hardware in the computer and cause the first instruction of the computer programs stored in the PROM 80*a* to be executed by the central processor 64*a*. A "power on" message is sent, in the manner previously described, to each of a plurality of state machine modules 90–93 (FIG. 10) in the computer causing the state machine modules to be initialized. The load signal values from the load cell 24 (FIG. 3A) are obtained by the processor 64*a* through conditioner 88 and converter 48 and stored in the RAM 84*a* (FIGS. 3A, 9) for use by the halt manager 91 (FIG. 10). The halt manager 91 then transmits this signal to the other modules upon request if the pump motor cannot be turned on.

The weigh handler 92 (FIG. 10) is responsible for displaying the current load value and updating it periodically (such as once per second) as long as a weigh key 96 is depressed. When the weigh key 96 is released, the last entered value is displayed and a zero adjust key 97 is enabled. If the zero adjust key 97 is selected, the current load value will continue to be displayed once per second. If an enter key 98 is selected, the current load value will become the new zero offset value for the system.

The halt manager 91 (FIG. 10) manages the function specified for the controller halt mode and the motor on/off switch (FIG. 12) is monitored. If the motor on/-off switch is moved to the off position then the HALT mode is entered. For safety reasons, the well can be "weighed" only if the controller is in the HALT mode, that is the motor on/off switch is in the off position. The halt manager also handles this requirement via an interface to the weigh handler module 92 and the plotter unit (FIG. 7).

When the halt manager 91 (FIG. 10) enters the HALT mode, it turns on a y raw integer flow from the math utility 90, and when the halt manager exits the halt state the y raw integer flow is turned off. If a weigh request is received from the weigh handler in the release or normal state then a "wait" message is returned from the halt manager 91 to the weigh manager 92. If, however, a weigh request is received from the weigh handler when the halt manager is in the halt state (FIG. 11) then a weight in the form of a y raw integer is returned to the halt manager.

A "clear" signal from the plotter system manager 93 (FIGS. 10, 11) enables the weigh key 96 and turns off the weigh/zero adjust lamps and clears any timers. The weigh handler 92 (FIG. 10) sends a weigh request message when the weighing or a zero adjustment is being made. If the controller is in the HALT mode, a wait message with the load value is returned; otherwise a weight message is returned. If the zero adjust key 97 (FIG. 10) has been selected, a weigh key light extinguishes and an enter key light is enabled. If the enter key 98 is selected, a ZEROADJUST SELECTED is sent to the halt manager 91 signifying that the present load signal is to be used as the new zero offset. If the new zero offset is in the proper range, a ZEROADJUSTVALUE (OKAY) is returned otherwise ZEROADJUSTVALUE (NOTOKAY) is returned.

Thus, the present invention provides method and apparatus for weighing a sucker-rod pumped well and for detecting malfunctions in the pumping unit using a computer to calculate corrected load values. A digital display unit provides periodic values of the weight of the well.

Although the best mode contemplated for carrying out the present invention has been herein shown and described, it will be apparent that modification and variation may be made without departing from what is regarded to be the subject matter of the invention.

What is claimed is:

1. Apparatus for detecting faults in downhole equipment of a sucker-rod pumped well by weighing the well and providing a digital display of the weight values, said well having a downhole pump which includes a standing valve and a plunger with a traveling valve, said equipment including a sucker-rod string connected between said plunger and a power unit to reciprocate said plunger to produce fluid from an underground location, said apparatus comprising:

transducer means for developing a signal representative of a load on said rod string;

means for selectively supporting said rod string independent of said transducer means to obtain a zero load value signal from said transducer means;

means for retaining said zero load signal for use in obtaining a corrected load signal when weighing said well;

means for halting the movement of said plunger at a position adjacent the top of an upstroke and at a position adjacent the bottom of a downstroke;

means for periodically calculating a corrected value of said load signal with said plunger in a stationary position; and means for displaying a corrected value of the load on said rod string using said corrected load signal.

2. Apparatus as defined in claim 1 wherein said displayed load value is used to determine the condition of said traveling valve and its associated equipment when said plunger is halted at a position adjacent the top of the upstroke, and said displayed load signal is used to determine the condition of said standing valve and its associated equipment when said plunger is halted at a position adjacent the bottom of said downstroke.

3. Apparatus as defined in claim 1 including means for periodically displaying said corrected value of said rod string load, and wherein a significant change in said rod string load indicates a fault in a predetermined one of said pump valves.

4. Apparatus as defined in claim 1 including means for periodically displaying said corrected value of said rod string load, wherein a progressive decrease in said rod string load with said plunger halted adjacent the top of an upstroke indicates a fault in said traveling valve and its associated equipment, and wherein a progressive increase in said rod string load with said plunger halted adjacent the bottom of a downstroke indicates a fault in said standing valve and its associated equipment.

5. Apparatus as defined in claim 1 wherein said display means includes a digital display unit for using said corrected load signal to periodically display an updated load value.

6. Apparatus as defined in claim 1 including digital computing means for calculating said corrected value of said load signal and using said corrected value to provide a corrected value of the rod string load.

7. Apparatus as defined in claim 1 including computing means for using said zero load signal to modify a weighing load signal to compensate for inaccuracies in signals developed by said transducer means and to obtain a corrected value of the load on said rod string.

8. Apparatus for detecting faults in equipment of a sucker-rod pumped well by weighing the well and providing a digital display of the weight values, said well having a downhole pump which includes a standing valve and a plunger with a traveling valve thereon, said equipment including a power unit to reciprocate said plunger to produce fluid from an underground location and a sucker-rod string connected to said plunger, said apparatus comprising:

transducer means for developing a signal representative of a load on said rod string;

means for connecting said transducer means between said rod string and said power unit;

means for temporarily supporting said rod string independent of said transducer means to obtain a zero load signal from said transducer means;

means for storing said zero load signal for use in obtaining a corrected load signal when weighing said well;

means for halting said plunger at a position adjacent the top of an upstroke and for halting said plunger at a position adjacent the bottom of a downstroke;

computing means for periodically calculating a corrected value of said load signal with said plunger in a stationary position; and means for displaying a corrected value of the load on said rod string using said corrected load signal.

9. Apparatus as defined in claim 8 including means for displaying a current load value and updating said load value periodically as long as a weigh key is depressed.

10. Apparatus as defined in claim 8 including means for entering a current load value as a new zero load value for the apparatus when an enter key is depressed.

11. Apparatus as defined in claim 8 including means for insuring that a corrected load signal is calculated only if the power unit is disabled.

12. Apparatus as defined in claim 8 wherein said display means includes a digital display unit for using said corrected load signal to periodically display an updated load value.

13. Apparatus as defined in claim 8 including digital computing means for calculating said corrected value of said load signal and using said corrected value to provide a corrected value of the rod string load.

14. Apparatus as defined in claim 8 including computing means for using said zero load signal to modify a weighing load signal to compensate for inaccuracies in signals developed by said transducer means and to obtain a corrected value of the load on said rod string.

15. A method of detecting and analyzing faults in downhole equipment of a sucker-rod pumped well by weighing the well and providing a digital display of the weight values, said well having a downhole pump which includes a standing valve and a plunger with a traveling valve, said equipment including a sucker-rod string connected to said plunger and a load measuring transducer connected between a power unit and an upper portion of said sucker-rod, said power unit reciprocating said plunger to produce fluid from an underground location, said method comprising the steps of:

supporting said rod string independent of said transducer to obtain a zero load signal from said transducer;

storing said zero load signal for use in correcting load signals when said transducer supports the weight of said plunger and said rod string;

halting said plunger at a position adjacent the top of an upstroke with said transducer supporting said plunger and said rod string;

taking a series of corrected load readings from said transducer with said plunger in a stationary position; and using said series of corrected load readings to check for faults in said traveling valve and its associated equipment.

16. A method as defined in claim 15 including the further steps of:

halting said plunger at a position adjacent the bottom of a downstroke with said transducer supporting said plunger and said rod string;

calculating a series of corrected load readings from said transducer with said plunger in a stationary position; and using said series of corrected load readings to check for faults in said standing valve and its associated equipment.

17. A method as defined in claim 15 including the further step of:

displaying said series of corrected load readings for use in checking and analyzing faults in said equipment.

* * * * *